United States Patent [19]

McGurk

[11] 4,037,720

[45] July 26, 1977

[54] BATTERY JUMPER CABLE CARRIER

[76] Inventor: Joseph McGurk, 121 NE 31st St., Pompano Beach, Fla. 33064

[21] Appl. No.: 708,561

[22] Filed: July 26, 1976

[51] Int. Cl.[2] ..... B65D 85/04; H01B 7/06

[52] U.S. Cl. ..... 206/328; 174/135; 339/29 B; 339/103 M

[58] Field of Search ..... 174/92, 135; 206/328, 206/329, 331, 334; 339/28, 103 B, 29 R, 29 B, 103 M, 103 R, 116 R, 119 C, 147 C, 157 C, 116 C, 228

[56] References Cited

U.S. PATENT DOCUMENTS

| | | | |
|---|---|---|---|
| 1,140,980 | 5/1915 | Haynes | 174/135 X |
| 2,118,731 | 5/1938 | Knott | 174/135 X |
| 2,699,960 | 1/1955 | Callery et al. | 174/138 F X |
| 3,068,316 | 12/1962 | Witt | 174/135 |
| 3,280,870 | 10/1966 | Bundy | 174/92 X |
| 3,372,887 | 3/1968 | Ladany | 174/135 X |
| 3,796,823 | 3/1974 | Wright et al. | 174/92 |
| 3,838,213 | 9/1974 | Georgopulos et al. | 174/92 X |
| 3,867,006 | 2/1975 | Jeffress | 339/103 M |
| 3,936,121 | 2/1976 | Leinberger | 339/29 B |

FOREIGN PATENT DOCUMENTS

| | | | |
|---|---|---|---|
| 1,398,290 | 3/1965 | France | 174/135 |
| 483,220 | 9/1929 | Germany | 339/28 |
| 1,911,654 | 9/1970 | Germany | 174/135 |
| 284,907 | 12/1952 | Switzerland | 174/135 |
| 410,099 | 10/1966 | Switzerland | 339/103 B |

*Primary Examiner*—Robert S. Ward, Jr.
*Attorney, Agent, or Firm*—Malin & Haley

[57] ABSTRACT

A battery jumper cable storage receptacle having a removable closure in combination with a pair of coiled battery jumper cables having battery terminal clamps disposed at their ends. The receptacle housing and the removable closure include apertures through which the cables are disposed. The exterior receptacle housing includes a plurality of clamp engaging holders to which the cable end clamps are affixed in the stored position. In the storage position, the coiled portion of the cable is positioned within the receptacle and the closure affixed thereto. In use, the closure is removed allowing full extension of the cable to connect a pair of DC battery terminals together.

5 Claims, 7 Drawing Figures

BATTERY JUMPER CABLE CARRIER

BACKGROUND OF THE INVENTION

This invention relates generally to a portable electrical connector carrier, and specifically to a battery jumper cable storage and utilization receptacle which allows expeditious utilization of battery jumper cables for rapidly coupling together of battery terminals or providing convenient and compact storage of the cables when they are not in use.

Electrical connectors (commonly referred to as jumper cables) have been utilized extensively for connecting the battery terminals of a disabled vehicle to another charged battery for starting the disabled vehicle. Many people carry a set of jumper cables in their vehicle trunk. One of the disadvantages of carrying the cables is that they are loosely disposed, cluttering the vehicle storage area and often become tangled and knotted. Because of the length of the cables they also take up additional storage space when loosely stored.

The purpose of the instant invention is to provide a portable device which compactly houses battery jumper cables when not in use and rapid deployment of the cables for electrically connecting battery terminals together.

BRIEF DESCRIPTION OF THE INVENTION

A portable battery jumper cable container and jumper cables comprising a pair of coiled electrical cables having a coiled intermediate portion in which the cable bodies are fused together, each of said cables having a battery terminal clamp disposed at each end and a portable housing for receiving the coiled portion of said cables, said housing having a removable closure mountable at one end. The housing end face and the removable closure each have apertures through which the cables are disposed. The exterior surface of the cable housing includes a plurality of battery terminal clamp engaging holders to which the battery terminal clamps are affixed in the stored position.

When stored, and not in use, the coiled portion of the jumper cables is retained within the housing and the closure affixed to one end, the battery terminal clamps being mounted on the clamp holders on the exterior of the device. A handle is affixed to the housing for carrying the device.

In the operational mode, when joining the terminals of two DC storage batteries electrically together, the removable closure is detached from the housing and the coiled cable is extended outwardly from the housing between the batteries. In the extended position the housing will be adjacent one end of the cables while the removable closure will be adjacent the other end of the cables. When the battery connection operation is completed, the coiled cable is easily positioned in the housing. The removable closure is then fixed to the housing and the clamps connected to the housing exterior clamp holders.

The housing and removeable closure are molded in symmetrical halves, the end and closure apertures (that receives the cables), dividing the apertures, such that the housing and closure are easily coupled together over the cable body, eliminating the need to thread the cable through the apertures prior to the addition of the clamps. Thus the housing can be mounted on complete jumper cables.

It is an object of this invention to provide a battery jumper container which allows expeditious extension of the cables for use and compact storage of the cables when not in use.

It is another object of this invention to provide a portable storage container for electrical connectors which is non-complex in operation and can be readily fabricated inexpensively.

And yet still another object of this invention is to provide a battery jumper cable storage device in which the battery cables may be expeditiously extended and restored into the storage housing.

In accordance with these and other objects which will be apparent hereinafter, the instant invention will now be described with particular reference to the accompanying drawings.

PREFERRED EMBODIMENT OF THE INSTANT INVENTION

Figure 1:
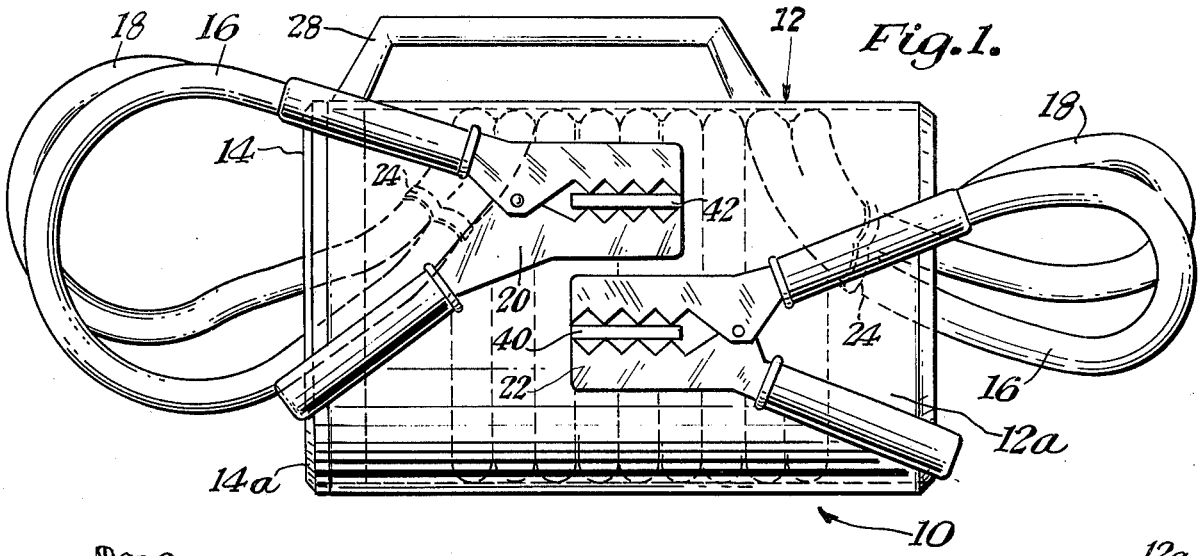
FIG. 1 shows a side elevational view of the instant invention in the storage mode of operation.
Figure 3:
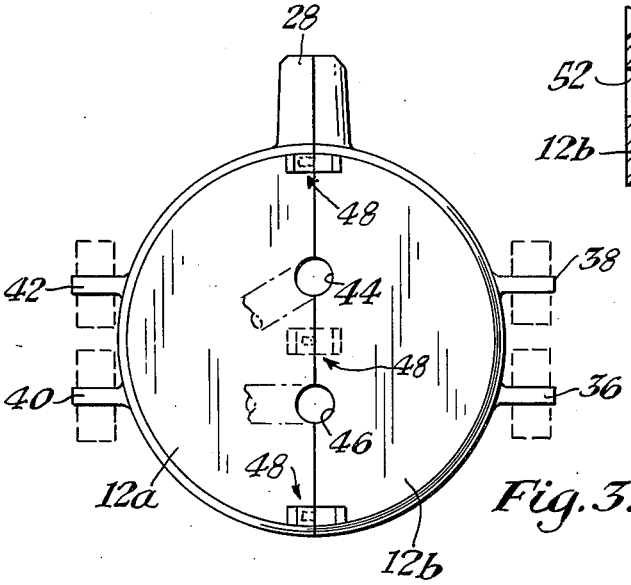
FIG. 3 shows an end elevational view of the cable housing utilized in the instant invention.

Referring now to the drawings and specifically FIG. 1, the instant invention is shown generally at 10 comprised of a molded plastic housing 12 which is cylindrical in shape and includes a removable closure 14 affixed to one end. Fused, coiled jumper cables 16 and 18 are shown disposed within the housing 12. Cable 16 includes a battery terminal clamp 20 disposed at one end and a terminal clamp 22 disposed at the opposite end. Terminal clamps 20 and 22 are attached to clamp holders 42 and 40, respectively, which are projections connected to the exterior surface of housing 12. Two similar terminal clamps holders 36 and 38 are disposed on the opposite side of the housing (FIG. 3). A handle 28 is affixed to the housing exterior for carrying the device. The cables 16 and 18 are disposed through apertures in the closed end surface of the housing and through apertures in the removable closue 14.

Figure 2A:
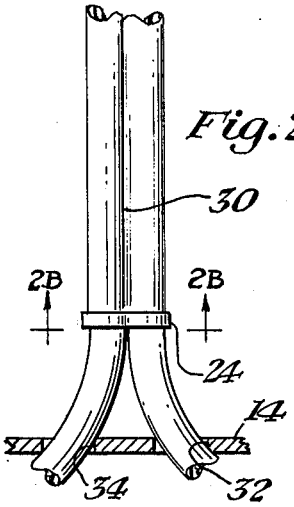
FIG. 2A shows a fragmentary top plan view of a portion of the jumper cables as utilized in the instant invention.
Figure 2B:
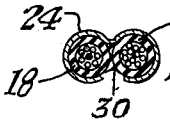
FIG. 2B shows a cross-sectional view through lines 2B—2B.

FIG. 2A shows a portion of the cable 16 and 18 having a molded seam 30 along one portion which molds the cables together to form a common single cable body which is coiled and constitutes the coiled portion normally stored in the housing 12. The ends of the fused cable body are split to allow separation of the terminal clamps for connection to the different terminals of a battery. Each fused seam terminates in a clip 24 which prevents tearing of the molded seam 30. As shown in FIG. 2A, the removable closure surface 14 includes a pair of apertures 32 and 34. The closure aperture receives cables 16 and 18. The opposite ends of the cables are received through apertures in the closed end surface of housing 12 and include a clip 24 (FIG. 1.)

FIG. 3 shows how the housing may be constructed in two molded segments 12*a* and 12*b* which may be affixed together by locking snaps 48 disposed around the inside periphery of each molded half. Integrally molded on the exterior surface are a plurality of clamp holders 36, 38, 40 and 42. The housing 12 is constructed in two mirror-image-like segments 12*a* and 12*b* to facilitate the construction of the device in that the cable end segments (which are passed through the housing end face and the removable closure) are encompassed by the halves, eliminating the necessity of passing cable ends through the apertures. Thus the housing and closure may be added to finished jumper cables having clamps.

Figure 4:
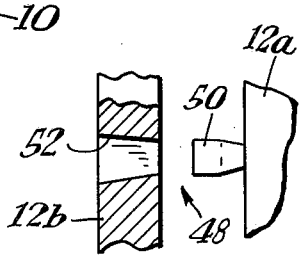
FIG. 4 shows a fragmentary side elevational view partially in cross-section of the housing connector snaps utilized in the instant invention.

FIG. 4 shows one of the plurality of locking snaps 48 which hold the housing sections 12*a* and 12*b* together and the removable closure halves together. One half of the molded bodies include a projecting flange 50 which is tapered to expand towards its free end which itself is received into a tapered groove 52 disposed in the other housing half. Thus, the flange 50 can be received into the groove 52 in housing 12*b* firmly retaining and locking the halves together. For operation of the device it is not necessary to separate the housing sections.

Figure 6:
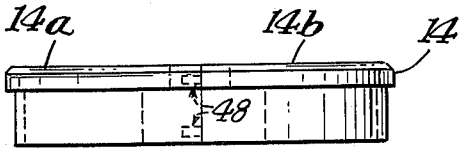
FIG. 6 shows a side elevational view of the removable closure utilized in the instant invention.
Figure 5:
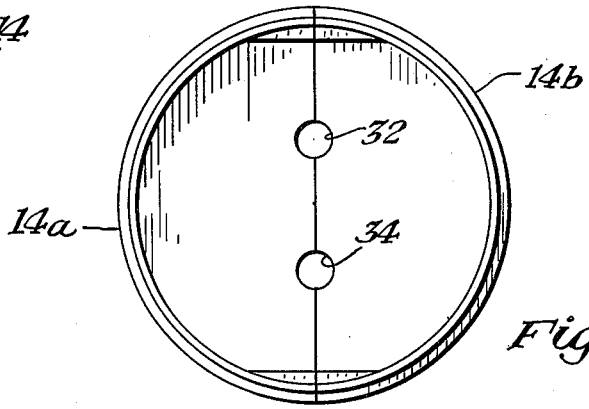
FIG. 5 shows a front elevational view of the removable closure utilized in the instant invention.

FIG. 5 shows the removable closure utilized with the instant invention which includes a pair of apertures 32 and 34 disposed through the closure surface. The closure is made in two halves 14*a* and 14*b* which are locked together with snaps 48 (FIG. 6). The cap 14 includes a lip disposed around its circumferential edge. The cap is sized to snugly fit within the free open end of the housing as shown in FIG. 1.

Referring back to FIG. 1, the device 10 is shown in its storage mode in which the cables 16 and 18 are coiled between the crimping clamps 24 and disposed within the housing 12, while the battery terminal clamps are firmly affixed to the clamp holders 40 and 42 and on the other side of the housing (not shown in FIG. 1). To utilize the device, closure 14 is removed and the fused coil cable section is extended and deployed from the housing 12. The clamps are connected to the respective battery terminals in a conventional manner. Upon completion of the operation, the coiled portion of the cable is then returned to the housing 12 and the closure 14 affixed to the free end of the housing.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. In combination, a pair of battery jumper cables and a portable storage receptacle for the cables comprising:

a cable housing, said housing having an open end and a closed end surface, said closed end surface including an aperture receiving a cable;

a housing closure removeably mounted on the open end of said housing, said closure having at least one aperture for receiving a cable disposed therethrough;

a pair of electrical cables disposable within said housing, one end of said cables disposed through said housing closed end surface aperture and the opposite end through said closure aperture;

a battery terminal clamp coupled to each end of said electrical cables; and cable slide preventing means coupled to said cable ends for retaining said closure adjacent one end of said cables and said housing closed end adjacent the opposite end of said cables to prevent relative movement of said closure and said housing relative to an intermediate portion of said cables.

2. The device as in claim 1, including said jumper cables being pre-coiled and having a fused intermediate portion and a pair of crimping clips connected about said cables inside said receptacle.

3. The device as in claim 1, including:

a plurality of clamp holders disposed on the exterior of said housing.

4. The device as in claim 1, including:

a handle fixed to said housing.

5. The device as in claim 1, wherein:

the housing includes symmetrical halves locked together by snaps, the housing halves joined to form the end wall apertures.

* * * * *